US007458210B2

(12) United States Patent
Kikuchi et al.

(10) Patent No.: US 7,458,210 B2
(45) Date of Patent: Dec. 2, 2008

(54) VEHICLE EXHAUST APPARATUS AND MOTORCYCLE EQUIPPED THEREWITH

(75) Inventors: Hiroyuki Kikuchi, Kobe (JP); Naoki Yokoyama, Takasago (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 11/638,449

(22) Filed: Dec. 14, 2006

(65) Prior Publication Data

US 2007/0137189 A1 Jun. 21, 2007

(30) Foreign Application Priority Data

Dec. 16, 2005 (JP) ..... P2005-363356

(51) Int. Cl.
*F01N 7/10* (2006.01)

(52) U.S. Cl. ..... 60/323; 60/313; 60/324

(58) Field of Classification Search ..... 60/313, 60/322, 323, 324
See application file for complete search history.

(56) References Cited

U.S. PATENT DOCUMENTS 4,420,933 A * 12/1983 Kajitani et al. ..... 60/302
4,953,352 A * 9/1990 Campbell ..... 60/313
6,487,854 B2 * 12/2002 Maus ..... 60/324
6,745,561 B2 * 6/2004 Kim ..... 60/323
6,840,039 B2 * 1/2005 Huh ..... 60/323
6,962,048 B2 * 11/2005 Ashida et al. ..... 60/302
2002/0083703 A1 * 7/2002 Werth et al. ..... 60/323

FOREIGN PATENT DOCUMENTS

JP 63-130618 8/1988
JP 6-73319 10/1994

* cited by examiner

*Primary Examiner*—Thomas E Denion
*Assistant Examiner*—Diem Tran
(74) *Attorney, Agent, or Firm*—Wenderoth, Lind & Ponack, L.L.P.

(57) ABSTRACT

In a vehicle exhaust apparatus constituting an exhaust passage to an exhaust muffler from a plurality of exhaust pipes connected to a multi-cylinder engine, an expansion chamber is formed along the exhaust passage and is connected to an exhaust collector portion. The expansion chamber is formed so as to expand outward from the exhaust collector portion in a substantially arc or chevron shape when viewed from a direction substantially orthogonal to an exhaust gasflow. Preferably, the expansion chamber is formed in a spherical shape and plural branched exhaust pipes are formed on the exhaust gas downstream side of the expansion chamber.

4 Claims, 13 Drawing Sheets

VEHICLE EXHAUST APPARATUS AND MOTORCYCLE EQUIPPED THEREWITH

BACKGROUND OF THE INVENTION

1. Field of the Invention

The present invention relates to a vehicle exhaust apparatus and a motorcycle equipped therewith, particularly to the vehicle exhaust apparatus constituting an exhaust passage to an exhaust muffler from plural exhaust pipes connected to a multi-cylinder engine, and the motorcycle equipped with the vehicle exhaust apparatus.

2. Description of the Related Art

Some vehicle exhaust apparatuses connected to a multi-cylinder engine have a structure in which individual cylinder exhaust pipes connected to cylinders are independently connected to respective exhaust mufflers. From the standpoint of compact piping space and exhaust gas pulsation attenuation, frequently the vehicle exhaust apparatus has a structure in which plural exhaust passages are collected at the midpoint of an exhaust passage or a structure in which the exhaust passage is rebranched into plural exhaust passages after they are collected.

FIGS. 18 and 19 show an example of a conventional motorcycle exhaust apparatus connected to a 4-cylinder 4-cycle engine 110. Referring to FIG. 18, which is a plan view, first, second, third, and fourth individual cylinder exhaust pipes 120-1, 120-2, 120-3, and 120-4 are connected to four cylinders of the engine 110 respectively, right and left mufflers 121 are arranged on both sides of a rear wheel 117, and the four individual cylinder exhaust pipes 120-1, 120-2, 120-3, and 120-4 and the two exhaust mufflers 121 are connected through upper and lower first exhaust collector pipes 123, a second exhaust collector pipe 124, right and left branched exhaust pipes 126, and right and left rear exhaust pipes 127.

Among the four individual cylinder exhaust pipes 120-1, 120-2, 120-3, and 120-4, the first individual cylinder exhaust pipe 120-1 and the fourth individual cylinder exhaust pipe 120-4 are collected to one upper exhaust passage by the upper first exhaust collector pipe 123. As shown in FIG. 19, which is a side view, the second individual cylinder exhaust pipe 120-2 and the third individual cylinder exhaust pipe 120-3 are collected to one lower exhaust passage by the lower first exhaust collector pipe 123. In the second exhaust collector pipe 124, the exhaust passage of the upper first exhaust collector pipe 123 and the exhaust passage of the lower first exhaust collector pipe 123 are collected in one exhaust passage. In the branched exhaust pipe 126, the exhaust passage of the second exhaust collector pipe 124 is rebranched into the right and left rear exhaust pipes 127. As for examples of conventional art, Japanese Utility Model Laid-Open No. S63-130618 discloses an exhaust apparatus similar to the above-described exhaust apparatus, and Japanese Utility Model Laid-Open No. H6-73319 discloses an exhaust apparatus in which the four individual cylinder exhaust pipes are finally collected in one exhaust muffler.

In the exhaust apparatus shown in FIGS. 18 and 19, an exhaust gasflow sectional area of a rear end portion 125 of the second exhaust collector pipe 124 is formed so as to be substantially equal to or smaller than the exhaust gasflow sectional area of a front half portion of the second exhaust collector pipe 124. In such exhaust apparatuses, a valley of an engine torque may be generated during acceleration in a low-speed range of the engine.

FIG. 17 shows a relationship between the engine speed and the engine torque. A graph X1 indicated by a broken line shows an engine torque change (torque curve) in the engine equipped with the exhaust apparatus of FIGS. 18 and 19. Referring to FIG. 17, in the conventional exhaust apparatus, during the acceleration in the low-speed range near the engine speed N1, there is generated a phenomenon called "torque valley" in which the torque is temporarily rapidly decreased and then raised as shown by a point P1. This phenomenon gives a rider a feeling that power of the engine is temporarily lost. That is, during the acceleration operation, because the torque is temporarily decreased against the rider's operation of accelerating, the operation does not feel comfortable.

In the conventional exhaust apparatuses disclosed in Japanese Utility Model Laid-Open Nos. S63-130618 and H6-73319, the collector portions of the individual cylinder exhaust pipes are each formed in an expanded shape such as a cylindrical shape to suppress the generation of the torque valley in the low-speed range. However, the expanded collector portion has little effect of eliminating the torque valley in the low-speed range.

SUMMARY OF THE INVENTION

In view of the foregoing, an object of the present invention is to enable smooth acceleration during acceleration in a low-speed range of the engine by following an acceleration operation by an operator of a vehicle without temporarily decreasing the engine torque, i.e., without generating a torque valley of the engine torque, and thereby maintaining a good operational feeling during acceleration.

In order to achieve the above-described object, a first aspect of the present invention provides a vehicle exhaust apparatus constituting an exhaust passage to an exhaust muffler from a plurality of exhaust pipes connected to a multi-cylinder engine, the vehicle exhaust apparatus including an exhaust collector portion in which the plurality of exhaust pipes are collected; and an expansion chamber which is connected onto an exhaust gas downstream side of the exhaust collector portion, the expansion chamber being formed so as to expand outward from the exhaust collector portion in a substantially arc or chevron shape when viewed in a direction substantially orthogonal to an exhaust airflow gasflow in the expansion chamber.

Since the expansion chamber whose inner peripheral surface is formed in the arc shape is connected onto the exhaust gas downstream side of the exhaust collector portion as in the above configuration, exhaust gases of the engine are collected in the exhaust collector portion from the plural exhaust pipes and then, flows into the expansion chamber immediately after the exhaust gases are collected or pass through a short distance in the exhaust collector portion, the mutual inference of the exhaust gases is decreased and the generation of large back pressure is prevented. Therefore, the exhaust gas can smoothly flow through the exhaust passage and the generation of the torque valley in the low-speed range of the engine can be eliminated. That is, during acceleration in the low-speed range, the acceleration of the engine can be smoothly performed by following the acceleration operation by the operator without temporarily decreasing the torque, and thereby a good operation feeling can be maintained during the acceleration operation.

Preferably, the expansion chamber may be formed in a substantially spherical shape.

According to the above configuration, the whole of the exhaust gas collected in the exhaust collector portion from the plural exhaust passages flows rapidly and smoothly to the exhaust gas downstream side along the inner surface of the spherical expansion chamber, so that the effect of eliminating the torque valley can be improved.

Preferably, the expansion chamber may be formed in a flattened shape in which the width in a vertical direction is narrower than the width in a horizontal direction.

According to the above configuration, the expansion chamber can easily be arranged even in a space where the size is restricted in the vertical direction like the lower space of the engine of the motorcycle.

Preferably, plural branched exhaust passages may be connected to an exhaust gas downstream side of the expansion chamber.

According to the above configuration, the plural branched exhaust passages (branched exhaust pipes) are connected to the exhaust gas downstream side portion of the expansion chamber to branch the exhaust gas, so that the exhaust gas can substantially evenly be divided into the branched exhaust passages.

A second aspect of the present invention provides a vehicle exhaust apparatus constituting an exhaust passage to an exhaust muffler from a plurality of exhaust pipes connected to a multi-cylinder engine, the vehicle exhaust apparatus including an expansion chamber which is formed in the midpoint of the exhaust passage, the expansion chamber being formed so as to expand outward from an exhaust passage portion adjacent to and connected to an exhaust gas upstream side of the expansion chamber in a substantially arc or chevron shape when viewed in a direction substantially orthogonal to an exhaust gasflow direction in the expansion chamber; and a plurality of branched exhaust passages which are connected to an exhaust gas downstream side portion of the expansion chamber.

According to the above configuration, the plural branched exhaust passages (branched exhaust pipes) are connected to the exhaust gas downstream side portion of the expansion chamber to branch the exhaust gas, so that the exhaust gas can substantially evenly be divided into the branched exhaust passages.

A third aspect of the present invention provides a motorcycle including a vehicle exhaust apparatus, which constitutes an exhaust passage to an exhaust muffler from a plurality of exhaust pipes connected to a multi-cylinder engine, the vehicle exhaust apparatus includes an exhaust collector portion in which the plurality of exhaust pipes are collected; and an expansion chamber which is connected onto an exhaust gas downstream side of the exhaust collector portion, the expansion chamber being formed so as to expand outward from the exhaust collector portion in a substantially arc or chevron shape when viewed in a direction substantially orthogonal to an exhaust gasflow direction in the expansion chamber.

In an acceleration operation of the motorcycle, generally a rider of the motorcycle grasps and rotates a throttle grip, and rapid response (sense of unity) of the vehicle movement is required corresponding to the operation. Therefore, by providing the above-described vehicle exhaust apparatus to the motorcycle, the operation feeling is further improved by eliminating the torque valley during acceleration in the low-speed range of the engine. The compactness of the exhaust apparatus can also be maintained.

DETAILED DESCRIPTION OF THE INVENTION

First Embodiment

A first embodiment of the present invention will be described below with reference to FIGS. 1 to 9.

(Schematic Configuration of Entire Motorcycle)

Figure 1:
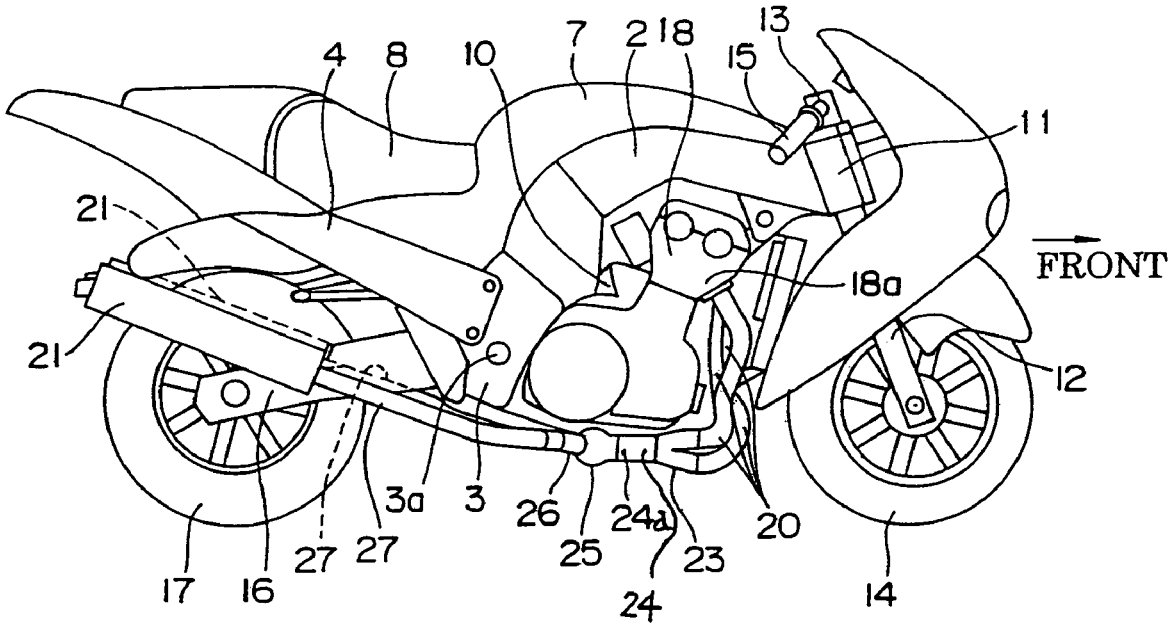
FIG. 1 is a right side view showing a motorcycle equipped with an exhaust apparatus according to a first embodiment of the present invention.

FIG. 1 is a right side view (side view on the right side of a rider) showing a motorcycle equipped with an exhaust apparatus according to the present invention. Referring to FIG. 1, a body frame includes mainly right and left main frames 2, right and left swinging arm brackets 3, and a rear frame 4. The swinging arm brackets 3 are formed at rear lower-end portions of the main frames 2. The rear frame 4 is extended behind and upward from the swinging arm brackets 3. A fuel tank 7, a seat 8, and the like are provided on the body frames 2, and a multi-cylinder engine 10 is mounted in a lower space of the main frames 2. A front fork 12 is supported in a head pipe 11 formed at the front end of the main frames 2, a handle 13 is provided in an upper end portion of the front fork 12 through the bracket or the like, and a front wheel 14 is supported in a lower end portion of the front fork 12. A grip 15 which can operate the accelerator is provided on the right-side end portion of the handle 13. The front end portion of a swinging arm 16 is swingably supported by a pivot portion 3*a* of the swinging arm brackets 3, which allows the swinging arm 16 to be vertically swung about a swinging fulcrum of the pivot portion 3*a*. A rear wheel 17 is supported in the rear end portion of the swinging arm 16.

The multi-cylinder engine 10 is a 4-cylinder 4-cycle engine in which four cylinders are arranged in line in a vehicle width direction. An exhaust port 18*a* for each cylinder opens at the front end face of a cylinder head 18, and an individual cylinder exhaust pipe 20 is connected to each exhaust port 18*a*. That is, a total of four individual cylinder exhaust pipes 20 are connected to the engine 10.

(Entire Configuration of Exhaust Apparatus)

The exhaust apparatus includes the four individual cylinder exhaust pipes 20, upper and lower first exhaust collector pipes 23, a second exhaust collector pipe 24, an expansion pipe 25, right and left branched exhaust pipes 26, right and left rear exhaust pipes 27, and right and left exhaust mufflers 21 in the order from the exhaust gas upstream side. The first exhaust collector pipes 23 are formed in a Y-shape while arranged below the engine 10. The second exhaust collector pipe 24 is connected to the rear ends of the first exhaust collector pipes 23. The expansion pipe 25 is connected to the rear end of the second exhaust collector pipe 24. The branched exhaust pipes 26 are connected to the rear half portion of the expansion pipe 25. The rear exhaust pipes 27 are extended rearward on both sides of the rear wheel 17 from the branched exhaust pipes 26. The exhaust mufflers 21 are arranged on both sides of the rear wheel 17. The exhaust passages of the four individual cylinder exhaust pipes 20 are collected in upper and lower exhaust passages at the first exhaust collector pipe 23, the two exhaust passages are collected in one exhaust passage at the second exhaust collector pipe 24, the one exhaust passage is branched into the right and left branched exhaust pipes (branched exhaust passages) 26 at the rear half portion of the expansion pipe 25, and the right and left branched exhaust pipes 26 lead to the right and left exhaust mufflers 21 through the right and left rear exhaust pipes 27 respectively. In the following, each exhaust apparatus component will be described in detail.

(Individual Cylinder Exhaust Pipe)

Figure 2:
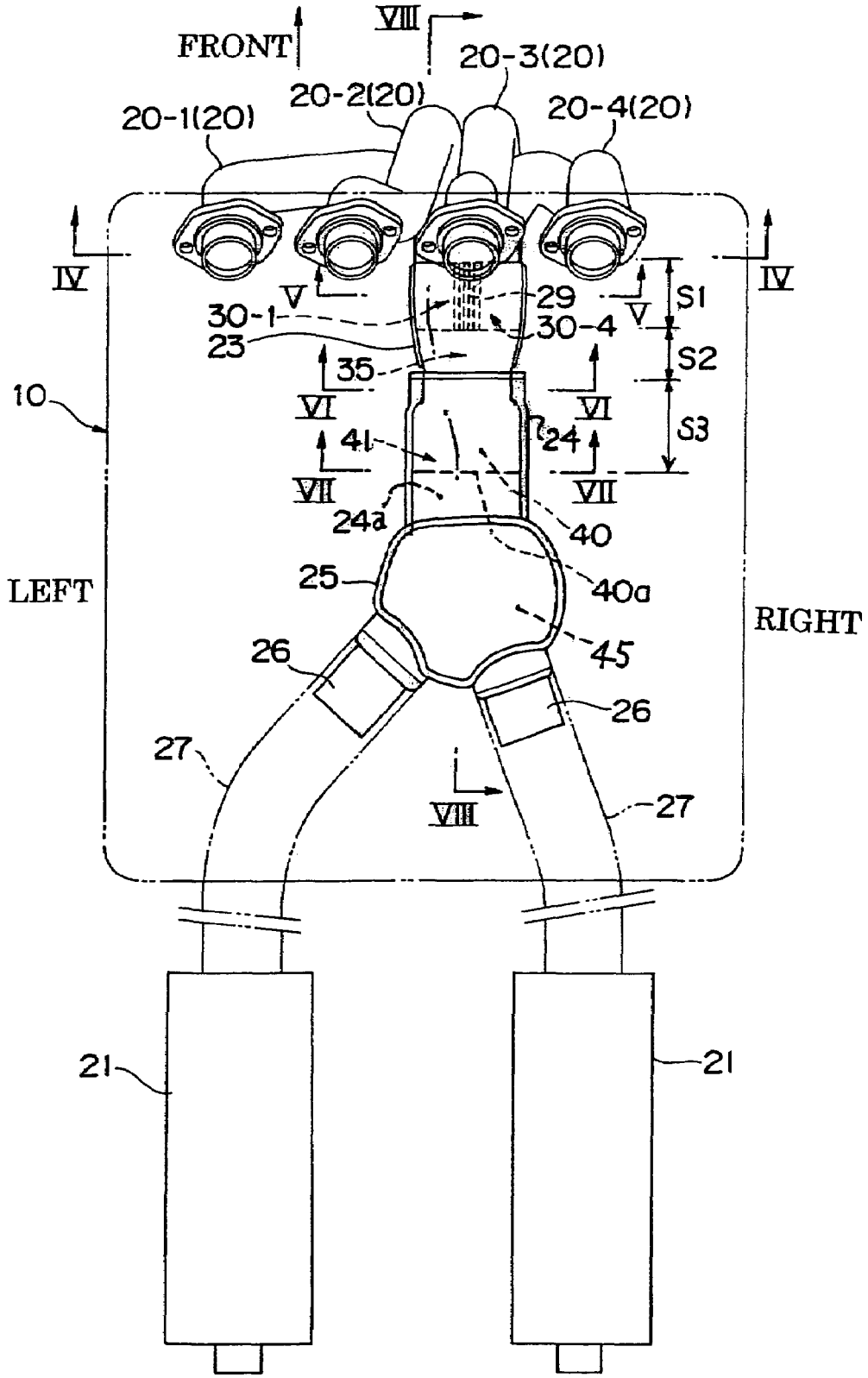
FIG. 2 is an enlarged plan view showing the exhaust apparatus of FIG. 1.

FIG. 2 is an enlarged plan view showing the exhaust apparatus. In order to identify the four individual cylinder exhaust pipes 20, the individual cylinder exhaust pipe 20 connected to the left-end first cylinder is set as a first individual cylinder exhaust pipe and designated by the numeral "20-1", the individual cylinder exhaust pipe 20 connected to the second cylinder located in the second left end is set as a second individual cylinder exhaust pipe and designated by the numeral "20-2", the individual cylinder exhaust pipe 20 connected to the third cylinder located in the third left end is set as a third individual cylinder exhaust pipe and designated by the numeral "20-3", and the individual cylinder exhaust pipe 20 connected to the fourth cylinder located in the right-end is set as a fourth individual cylinder exhaust pipe and designated by the numeral "20-4". The individual cylinder exhaust pipes 20-1, 20-2, 20-3, and 20-4 are extended downward at the front side of the engine 10, and are collected at the central portion of the horizontal width in the vicinity of the front lower-end portion of the engine 10. Then, as shown in the side view of FIG. 3, the individual cylinder exhaust pipes 20-1, 20-2, 20-3, and 20-4 are curved rearward, and are connected to front-end inlet ports of the upper and lower first exhaust collector pipes 23.

(First Exhaust Collector Pipe)

Figure 4:
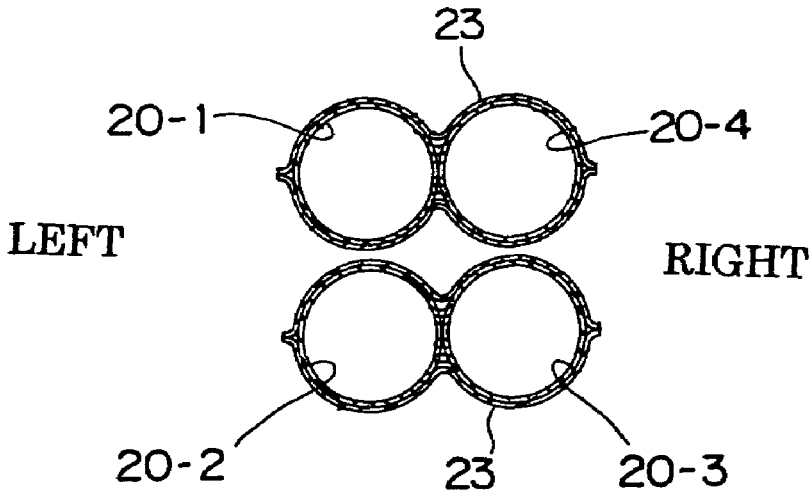
FIG. 4 is an enlarged sectional view taken on line IV-IV of FIG. 2.

FIG. 4 is an enlarged sectional view taken on line IV-IV of FIG. 2, and shows a section of a fitting portion between the lower end portions of the individual cylinder exhaust pipes 20-1, 20-2, 20-3, and 20-4 and the front-end inlet ports of the upper and lower first exhaust collector pipes 23. Each of the first exhaust collector pipes 23 is formed in a peanut shape in which the central portion of the horizontal width is constricted. The lower end portions of the first individual cylinder exhaust pipe 20-1 and fourth individual cylinder exhaust pipe 20-4 are connected to the upper first exhaust collector pipe 23, and the lower end portions of the second individual cylinder exhaust pipe 20-2 and third individual cylinder exhaust pipe 20-3 are connected to the lower first exhaust collector pipe 23.

Figure 5:
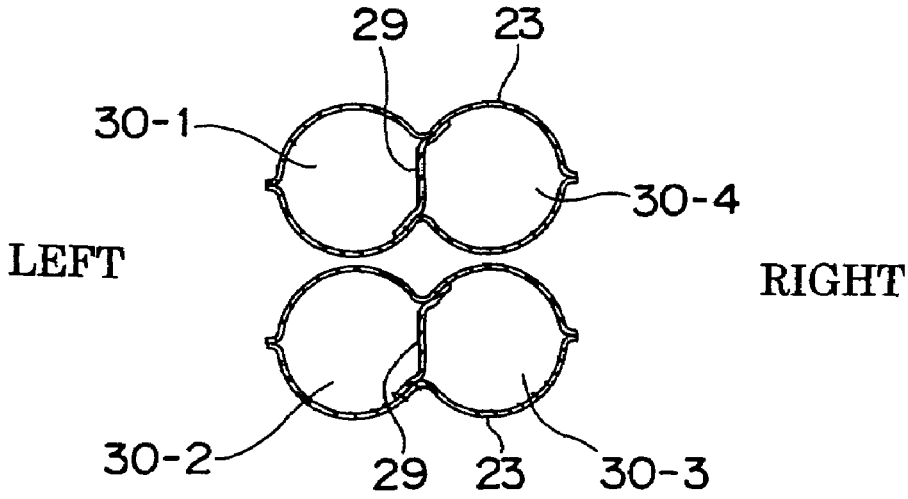
FIG. 5 is an enlarged sectional view taken on line V-V of FIG. 2.

FIG. 5 is an enlarged sectional view taken on line V-V of FIG. 2, and shows a cross section of a front half portion of the first exhaust collector pipe 23. A partition plate 29 is provided in the constricted portion of the central portion in the horizontal width of each first exhaust collector pipe 23, the upper first exhaust collector pipe 23 is partitioned into a first cylinder exhaust passage 30-1 and a fourth cylinder exhaust passage 30-4 by the partition plate 29, and the lower first exhaust collector pipe 23 is partitioned into a second cylinder exhaust passage 30-2 and a third cylinder exhaust passage 30-3 by the partition plate 29.

As shown in FIG. 2, the partition plate 29 is provided in a zone S1 from the front end to the midpoint of the first exhaust collector pipe 23, and a first exhaust collector portion is formed at the back of the rear end of the partition plate 29.

Figure 3:
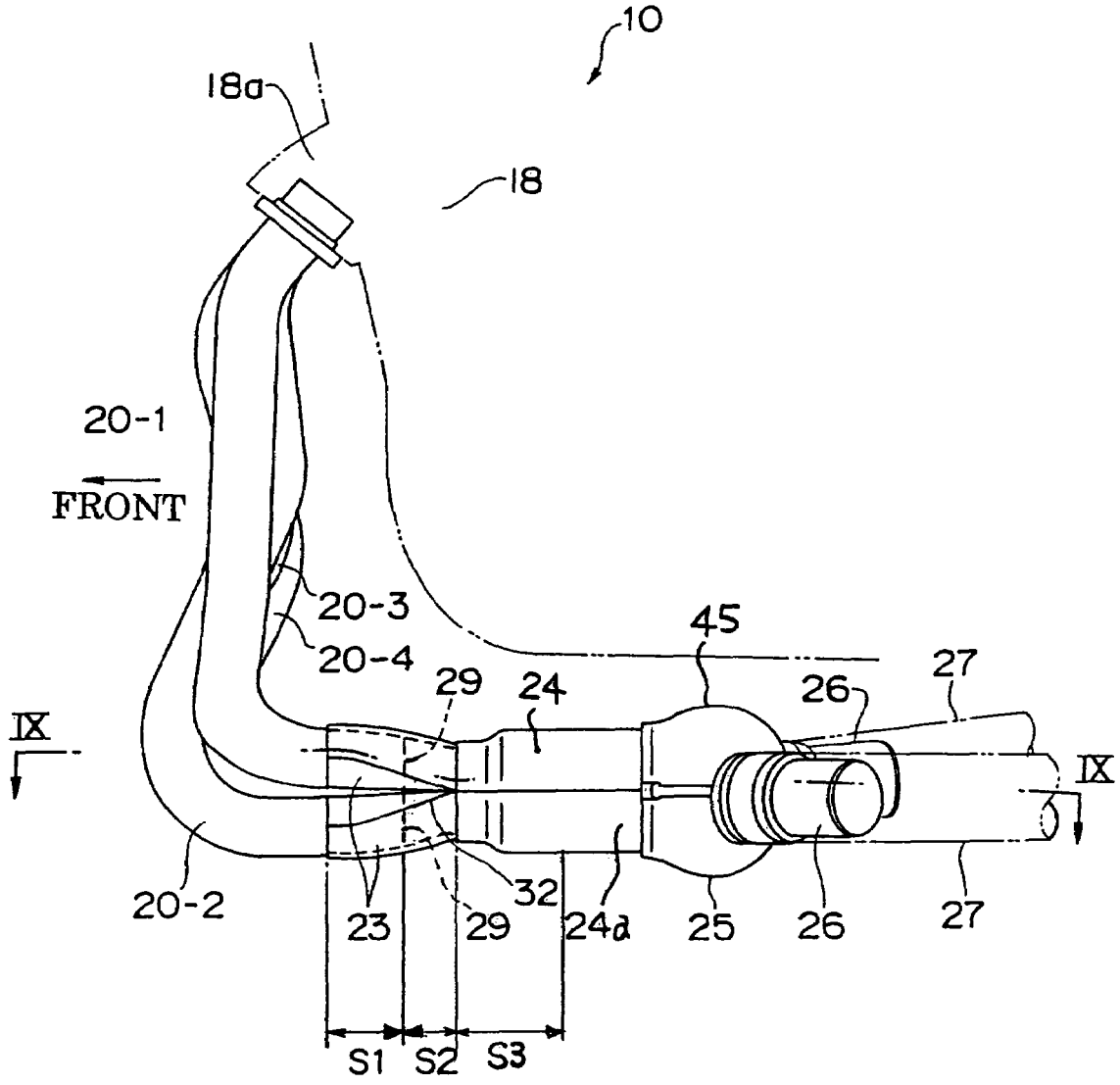
FIG. 3 is a left side view showing the exhaust apparatus of FIG. 2.
Figure 6:
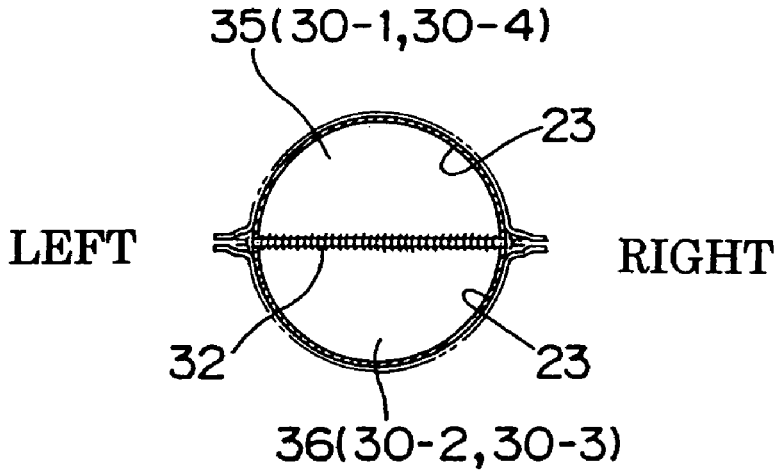
FIG. 6 is an enlarged sectional view taken on line VI-VI of FIG. 2.

FIG. 6 is an enlarged sectional view taken on line VI-VI of FIG. 2, and shows a vertical section of the rear end portion (first exhaust collector portion) of the first exhaust collector pipe 23. Each of the upper and lower first exhaust collector pipes 23 is formed in a semi-cylindrical shape, and the first exhaust collector pipes 23 are coupled to each other such that the section forms a substantially circular shape as a whole. The first exhaust collector pipe 23 is partitioned into an upper exhaust passage 35 and a lower exhaust passage 36 by a substantially horizontal division wall 32 formed in the center of the vertical direction. The upper exhaust passage 35 is a passage in which the first and fourth cylinder exhaust passages 30-1 and 30-4 are collected, and the lower exhaust passage 36 is a passage in which the second and third cylinder exhaust passages 30-2 and 30-3 are collected. As shown in FIGS. 2 and 3, the division wall 32 is provided in a zone S2 from the vicinity of the rear end of the partition plate 29 to the rear end of the first exhaust collector pipe 23.

(Second Exhaust Collector Pipe and Expansion Pipe)

Figure 7:
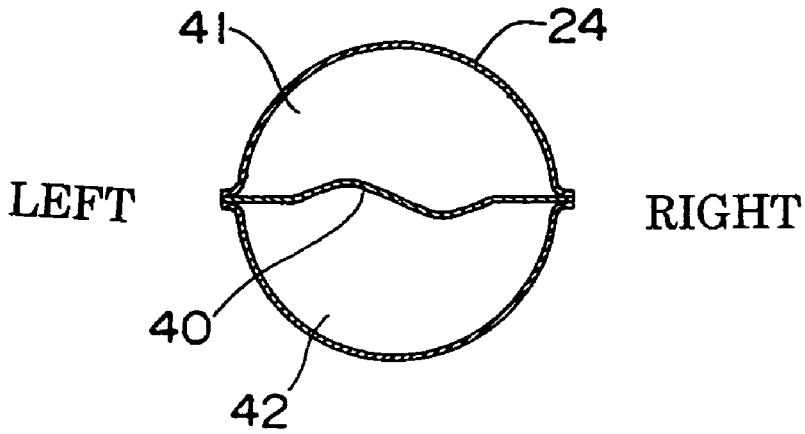
FIG. 7 is an enlarged sectional view taken on line VII-VII of FIG. 2.

FIG. 7 is an enlarged sectional view taken on line VII-VII of FIG. 2, and shows a cross section of the front half portion of the second exhaust collector pipe 24. In the front half portion of the second exhaust collector pipe 24, the section is formed in a substantially circular shape, and a partition plate 40 having a wave shape is provided substantially horizontally in the center of the vertical direction. Therefore, the second exhaust collector pipe 24 is partitioned into an upper exhaust passage 41 and a lower exhaust passage 42 by the partition plate 40, and the upper and lower exhaust passages 41 and 42 are communicated with the upper exhaust passage 35 and lower exhaust passage 36 of the first exhaust collector pipe 23 of FIG. 6 respectively.

Figure 8:
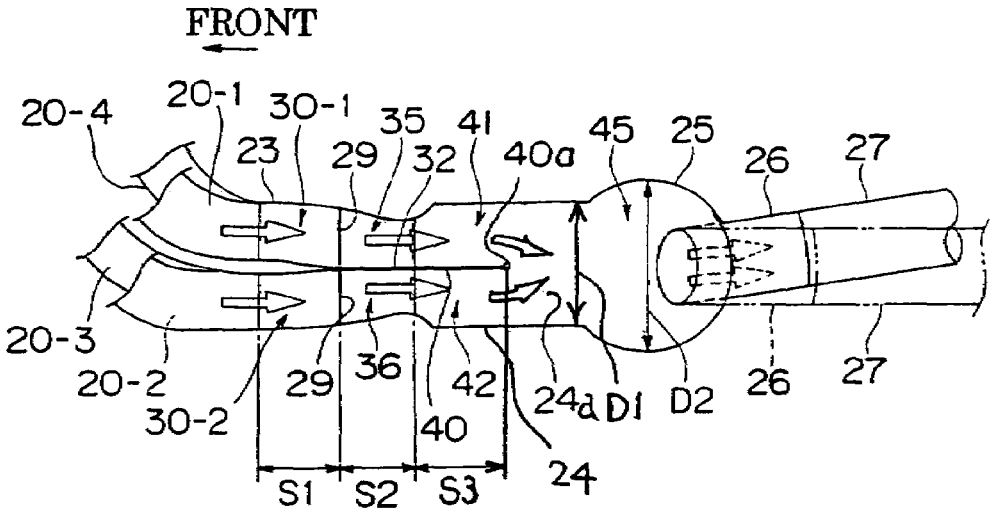
FIG. 8 is an enlarged sectional view taken on line VIII-VIII of FIG. 2.

FIG. 8 is an enlarged sectional view taken on line VIII-VIII of FIG. 2, and shows the longitudinal section of the first and second exhaust collector pipes 23 and 24 and the vicinity thereof. The partition plate 40 of the second exhaust collector pipe 24 is coupled to the rear end of the division wall 32 of the first exhaust collector pipe 23, the partition plate 40 is provided in a zone S3 to the midpoint of the second exhaust collector pipe 24, and the inside of the second exhaust collector pipe 24 located at the back of the rear end 40*a* of the partition plate 40 constitutes a second exhaust collector portion 24*a*. The expansion pipe 25 is connected to the rear side (exhaust gas downstream side) of the second exhaust collector portion 24*a*. The expansion pipe 25 is formed in a substantially spherical shape such that the diameter of the expansion pipe 25 is larger than the diameter D1 of the second exhaust collector portion 24*a* of the second exhaust collector pipe 24, and the right and left branched exhaust pipes 26 projected rearward are joined by welding to the rear half portion (exhaust gas downstream side portion) of the spherical expansion pipe 25.

A substantially spherical expansion chamber 45 corresponding to an outer peripheral surface shape of the expansion pipe 25 is formed in the spherical expansion pipe 25. That is, the inner peripheral surface shape of the expansion chamber 45 is formed in an arc shape expanded outward from the second exhaust collector portion 24*a* when viewed from any direction substantially orthogonal to the exhaust gasflow direction, and the inner diameter D2 of the expansion chamber 45 is set to be larger than the inner diameter D1 in the cylindrical portion of the second exhaust collector portion 24*a* of the second exhaust collector pipe 24. Therefore, in the expansion chamber 45, the exhaust gasflow sectional area is enlarged along the spherical inner surface from the rear end of the second exhaust collector portion 24*a* toward the rear side (exhaust gas downstream side), and then the exhaust gasflow sectional area is decreased along the spherical inner surface.

(Branched Exhaust Pipe)

Figure 9:
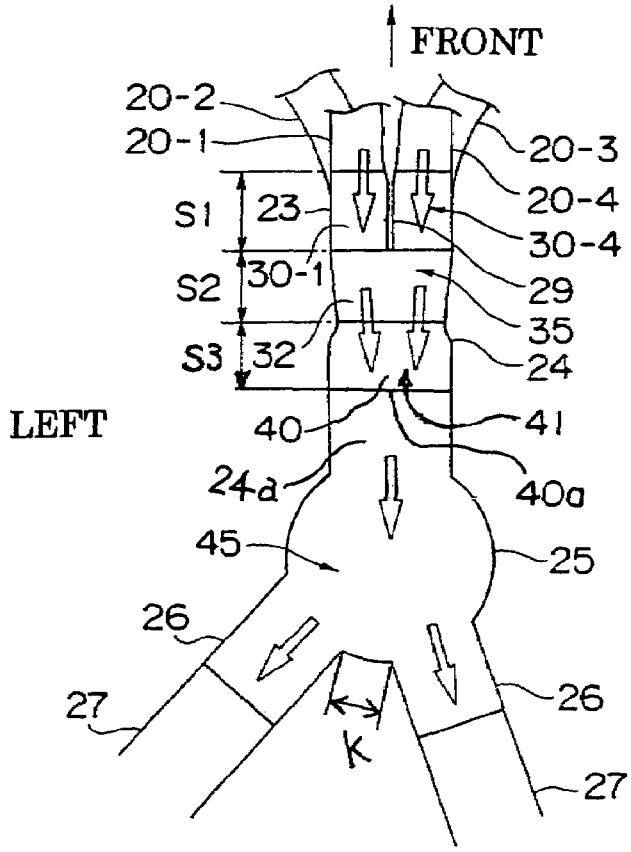
FIG. 9 is an enlarged sectional view taken on line IX-IX of FIG. 3.

FIG. 9 is a simplified sectional view taken on line IX-IX of FIG. 3. The right and left branched exhaust pipes (branched exhaust passages) 26 and 26 are provided so as to be extended rightward and leftward in a V-shape from the rear half portion of the expansion pipe 25, and front end portions of the branched exhaust pipes 26 and 26 are horizontally separated from each other by a constant K. Thus, when the front end portions of the branched exhaust pipes 26 and 26 are horizontally separated from each other, the welding work of each of the branched exhaust pipes 26 and 26 to the expansion pipe 25 is facilitated, and a function of evenly distributing the exhaust gas into right and left sides is also improved.

(Rear Exhaust Pipe and Exhaust Muffler)

Referring to FIG. 2, the front end portions of the right and left rear exhaust pipes 27 are connected to the right and left branched exhaust pipes 26 respectively, and the right and left exhaust mufflers 21 are connected by welding and the like to the rear end portions of the rear exhaust pipes 27 respectively.

(Flow and Action of Exhaust Gas)

As shown in FIGS. 8 and 9, the exhaust gases discharged to the exhaust passages of the four individual cylinder exhaust pipes 20-1, 20-2, 20-3, and 20-4 from the cylinders of the engine 10 of FIG. 2 are collected in the upper and lower exhaust passages 35 and 36 by the first exhaust collector pipe 23. That is, the exhaust gases from the first and fourth cylinders are collected in the upper exhaust passage 35, and the exhaust gases from the second and third cylinders are collected in the lower exhaust passage 36.

Then, the exhaust gas in the upper exhaust passage 35 of the first exhaust collector pipe 23 passes through an upper exhaust passage 41 of the front half portion of the second exhaust collector pipe 24 and flows into the second exhaust collector portion 24*a* of the rear half portion. On the other hand, the exhaust gas in the lower exhaust passage 36 of the first exhaust collector pipe 23 passes through a lower exhaust passage 42 of the front half portion of the second exhaust collector pipe 24 and flows into the second exhaust collector portion 24*a* of the rear half portion. That is, the exhaust gases from the upper and lower exhaust passages 41 and 42 are collected in the second exhaust collector portion 24*a*.

As described above, the exhaust gas collected in the second exhaust collector portion 24*a* flows into the expansion chamber 45 immediately after the exhaust gases are collected or after the exhaust gas passes through a short distance. The exhaust gas is temporarily expanded while flowing rearward along the arc-shape inner peripheral surface of the expansion chamber 45, and is horizontally branched into the right and left branched exhaust pipes 26.

The exhaust gases flow from the right and left branched exhaust pipes 26 to the right and left rear exhaust pipes 27 respectively, and reach the right and left exhaust mufflers 21 (FIG. 2). Then the exhaust gases are discharged to the outside.

In the first embodiment, the plural exhaust passages are collected in the second exhaust collector portion 24*a* of the second exhaust collector pipe 24, and the second exhaust collector pipe 24 is immediately connected to the expansion chamber 45. In this embodiment, since the inner peripheral surface of the expansion chamber 45 is formed in a substantially spherical shape while the volume of the expansion chamber 45 is larger than that of the second exhaust collector portion 24*a*, the whole of the exhaust gas is smoothly expanded along the spherical surface with no disturbance and flows rearward, and the exhaust gas is substantially evenly discharged to the right and left branched exhaust pipes (branched exhaust passages) 26. It is preferable that a volume of the expansion chamber 45 is larger than that of the second exhaust collector. However, the volume of the expansion chamber may be decided appropriately depending on its shape and an association with the exhaust pipe.

Figure 17:
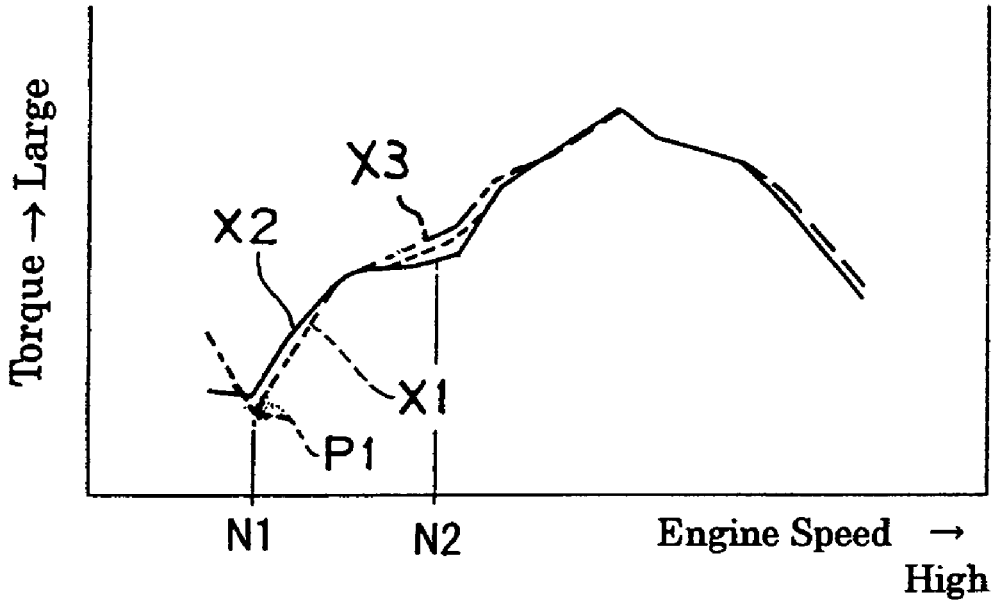
FIG. 17 shows a relationship between the number of engine revolutions and torque.
Figure 18:
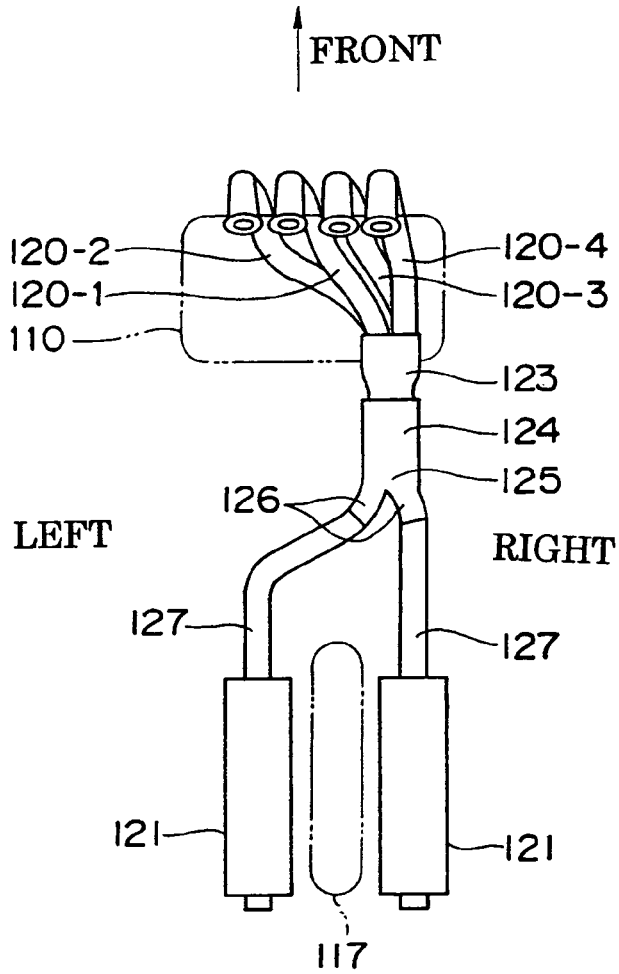
FIG. 18 is a plan view showing a conventional vehicle exhaust apparatus.
Figure 19:
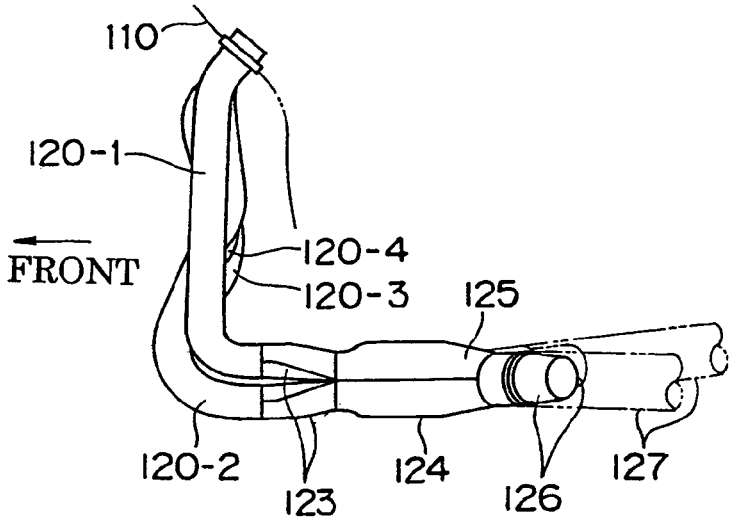
FIG. 19 is a left side view showing the exhaust apparatus of FIG. 18.

A graph X2 indicated by a solid line of FIG. 17 shows the torque change (torque curve) when the exhaust apparatus of the first embodiment is used. During the acceleration in the low-speed range (near the engine speed N1), in the above-described conventional techniques, "torque valley P1" in which the torque is raised after the torque is temporarily rapidly decreased is generated as shown by the graph X1 of the broken line. On the contrary, in the first embodiment, as shown by the graph X2 of the solid line, acceleration can rapidly be performed without generating the torque valley P1 in the low-speed range. Accordingly, the operator can comfortably perform an acceleration operation in the low-speed range with no sense of discomfort.

Second Embodiment

Figure 10:
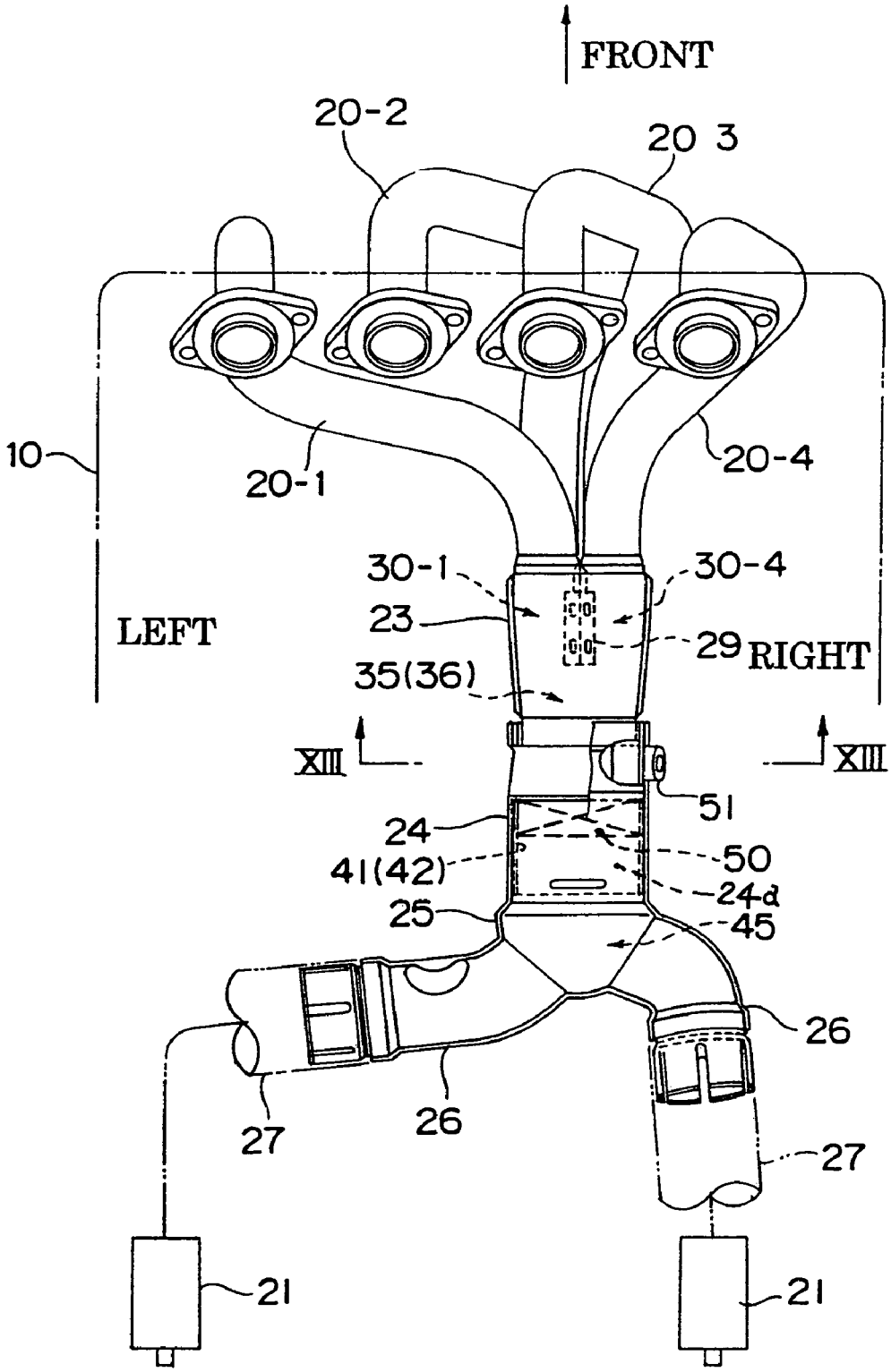
FIG. 10 is a plan view showing an exhaust apparatus according to a second embodiment of the present invention.

FIGS. 10 to 13 show a second embodiment of the present invention. Referring to FIG. 10, which shows a plan view of an exhaust apparatus, the exhaust apparatus of the second embodiment has the basic structure similar to that of the first embodiment. The exhaust apparatus of the second embodiment includes the four individual cylinder exhaust pipes 20-1, 20-2, 20-3, and 20-4, the upper and lower of first exhaust collector pipes 23, the second exhaust collector pipe 24, the expansion pipe 25, the right and left branched exhaust pipes 26, the right and left rear exhaust pipes 27, and the right and left exhaust mufflers 21 in the order from the exhaust gas upstream side. The first exhaust collector pipes 23 are arranged below the engine 10. The second exhaust collector pipe 24 is connected to rear ends of the first exhaust collector pipes 23. The expansion pipe 25 is connected to the rear end of the second exhaust collector pipe 24. The branched exhaust pipes 26 are connected to the rear half portion of the expansion pipe 25. The rear exhaust pipes 27 are connected to the branched exhaust pipes 26 respectively. The exhaust mufflers 21 are connected to the rear end portions of the rear exhaust pipes 27 respectively. The exhaust gases passing through the exhaust passages of the four individual cylinder exhaust pipes 20-1, 20-2, 20-3, and 20-4 are collected in the upper and lower exhaust passages 35 and 36 by the first exhaust collector pipe collector pipe 23, and the exhaust gases passing through the two exhaust passages are collected in one exhaust gas at the second exhaust collector portion 24*a* formed in the rear half portion of the second exhaust collector pipe 24 similar to the first embodiment. Immediately after the exhaust gases are collected in the second exhaust collection portion 24*a*, the exhaust gas flows into the expansion chamber 45 of the expansion pipe 25 and expands in the expansion chamber 45, and then, the exhaust gases flow into the right and left branched exhaust pipes 26 and into right and left exhaust mufflers 21 through the right and left rear exhaust pipes 27. In the second embodiment, the same or similar components as in the first embodiment are designated by the same numerals.

Figure 11:
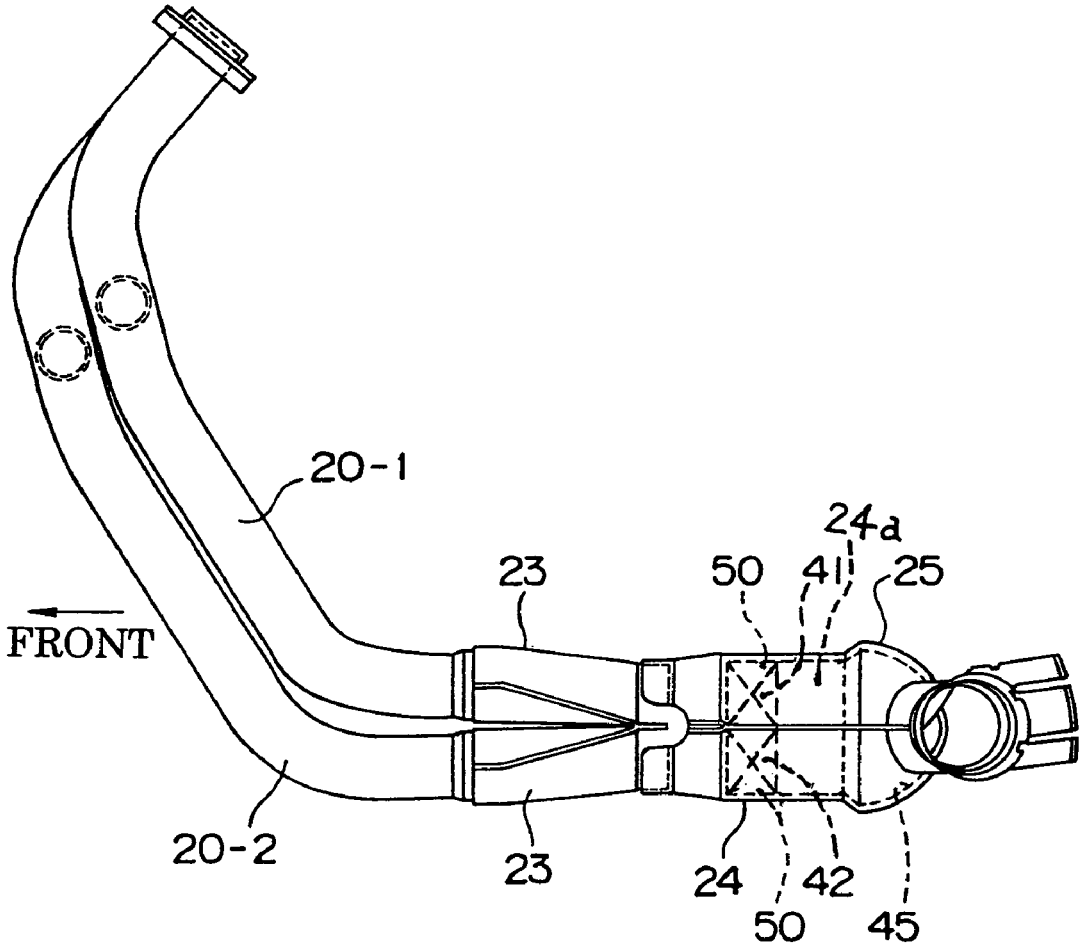
FIG. 11 is a left side view showing the exhaust apparatus of FIG. 10.
Figure 12:
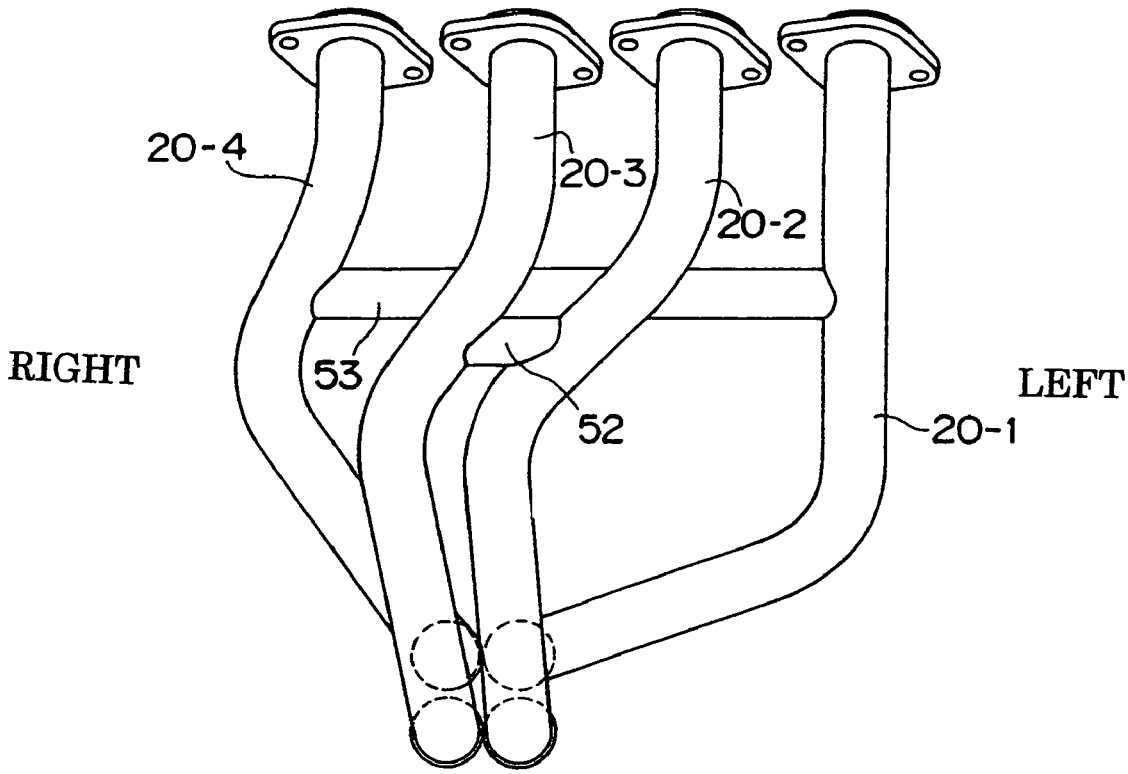
FIG. 12 is a front view showing the exhaust apparatus of FIG. 10.

As shown in FIG. 11, which is a left side view, the configuration of the second embodiment differs from that of the first embodiment in the following points. That is, the expansion pipe 25 and the expansion chamber 45 are formed in substantially hemispherical shapes, two catalysts 50 are attached to the front half portion of the second exhaust collector pipe 24, as shown in FIG. 10, oxygen sensor attachment boss portions 51 are provided in front of the catalysts 50 in the exhaust passages 41 and 42, and as shown in FIG. 12 which is a front view, communicating tubes 52 and 53 which communicate the individual cylinder exhaust pipe 20-1, 20-2, 20-3, and 20-4 with one another are provided. The configurations different from those of the first embodiment will be described below.

(Expansion Chamber)

Referring to FIG. 11, as described above, the expansion chamber 45 connected to the rear side of the second exhaust collector portion 24*a* is formed in a substantially hemispherical shape in which the front half is cut. Therefore, the exhaust gasflow sectional area of the expansion chamber 45 is enlarged at a burst from the rear end of the second exhaust collector portion 24*a*, and then the exhaust gasflow sectional area is gradually decreased along the spherical surface.

Thus, the expansion chamber 45 connected to the rear side of the second exhaust collector portion 24*a* is formed in a substantially hemispherical shape in which the front half is cut. Therefore, the effect of eliminating the torque valley substantially equal to that of the substantially spherical expansion chamber of the first embodiment can be expected, and a compact size can be realized in the lengthwise direction of the expansion pipe 25.

(Catalyst and Oxygen Sensor Attachment Boss Portion)

Figure 13:
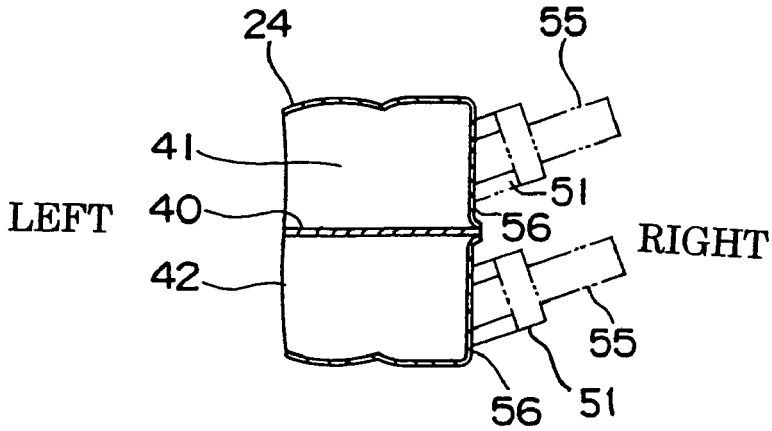
FIG. 13 is an enlarged sectional view taken on line VIII-VIII of FIG. 10.

Referring to FIG. 11, the catalysts 50 are honeycomb type catalysts, and the catalysts 50 are attached to the insides of the upper and lower exhaust passages 41 and 42 in the front half portion of the second exhaust collector pipe 24 respectively. Referring to FIG. 13, which is an enlarged sectional view taken on line VIII-VIII of FIG. 10, a right side wall 56 in the front half portion of the second exhaust collector pipe 24 is formed in a flat-shape, and the oxygen sensor attachment boss portions 51 are fixed to the right side walls 56 by welding respectively. An oxygen sensor 55 is attached in an airtight manner to each of the oxygen sensor attachment boss portions 51 to measure an oxygen concentration.

(Communicating Tube)

Referring to FIG. 12, the midpoint of the first individual cylinder exhaust pipe 20-1 and the midpoint of the fourth individual cylinder exhaust pipe 20-4 are communicated with each other by the communicating tube 53, and the midpoint of the second individual cylinder exhaust pipe 20-2 and the midpoint of the third individual cylinder exhaust pipe 20-3 are communicated with each other by the communicating tube 52.

According to the above configuration, communicated individual cylinder exhaust pipes can also be used with each other as the exhaust passage, so that the torque and output can be enhanced in the intermediate-speed range and high-speed range.

A graph X3 indicated by a phantom line of FIG. 17 shows the torque change (torque curve) when the above-described communicating tubes 52 and 53 are provided. In an intermediate-speed or high-speed range (near the engine speed N2), the torque can be enhanced compared with the graph X2 where the communicating tube is not provided. Although not shown, the output is also enhanced.

Third Embodiment

Figure 14:
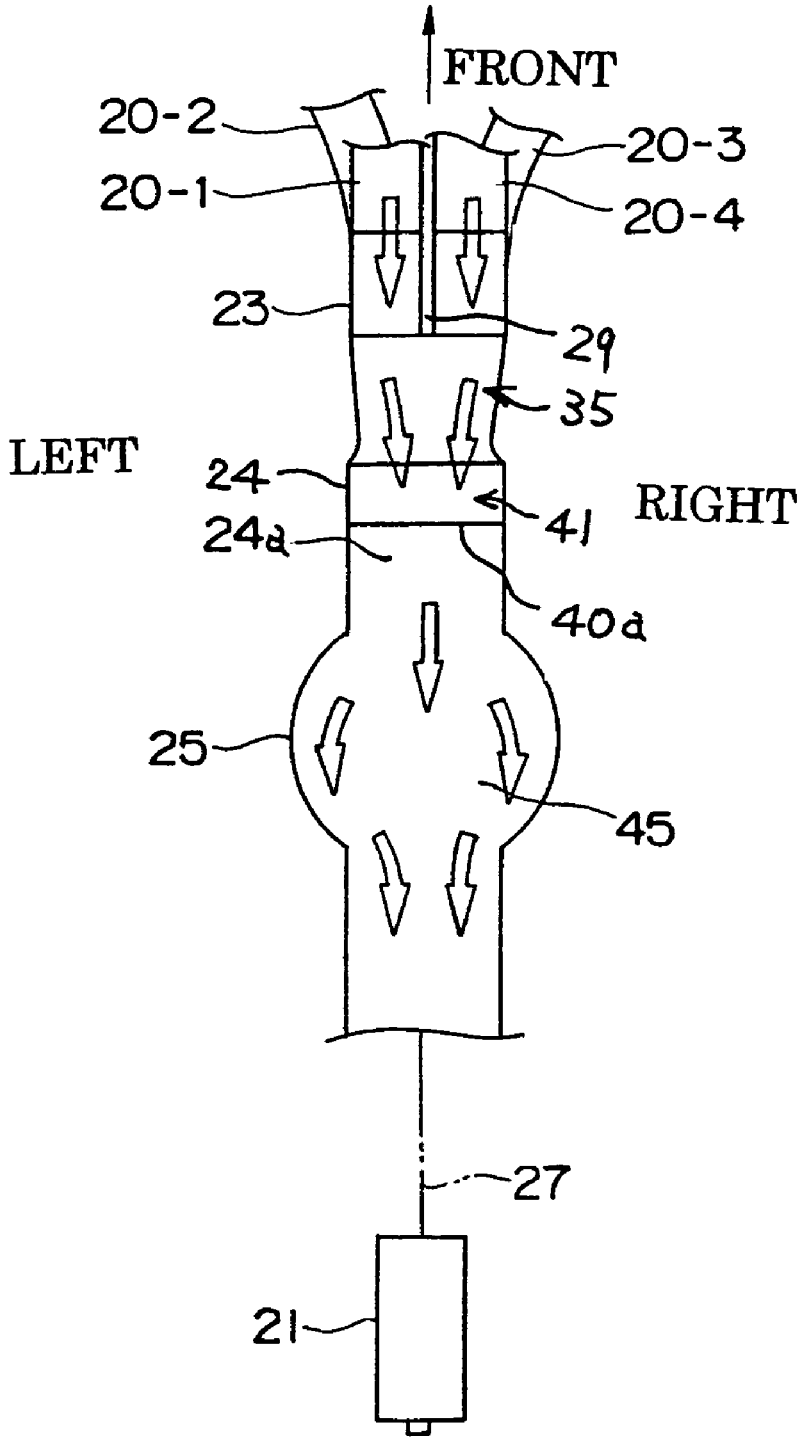
FIG. 14 is a longitudinal sectional view showing the vicinity of a collector pipe of an exhaust apparatus according to a third embodiment of the present invention.

FIG. 14 shows a third embodiment of the present invention, and shows a horizontal section (corresponding to FIG. 9) near the first and second exhaust collector pipes 23 and 24. Referring to FIG. 14, the exhaust apparatus includes the four individual cylinder exhaust pipes 20-1, 20-2, 20-3, and 20-4, the upper and lower first exhaust collector pipes 23, the second exhaust collector pipe 24, and the expansion chamber 45 in the order from the exhaust gas upstream side. The substantially spherical expansion chamber 45 is connected to the rear side of the second exhaust collector portion 24*a* in the rear half portion of the second exhaust collector pipe 24. These structures of the third embodiment are similar to those of the first embodiment. However, in the third embodiment, only one exhaust muffler 21 is connected to the rear portion of the expansion pipe 25 through only one rear exhaust pipe 27. In the third embodiment, the same components as in the first embodiment are designated by the same numerals.

Thus, in the exhaust apparatus in which the four individual cylinder exhaust pipes 20-1, 20-2, 20-3, and 20-4 are finally collected in one exhaust muffler 21 and as with the first embodiment, the substantially spherical expansion chamber 45 is immediately connected to the second exhaust collector portion 24*a* in the rear half portion of the second exhaust collector pipe 24. Therefore, the torque valley can be eliminated during the acceleration in the low-speed range of the engine, and the feeling of acceleration can be made comfortable as with the first embodiment.

Fourth Embodiment

Figure 15:
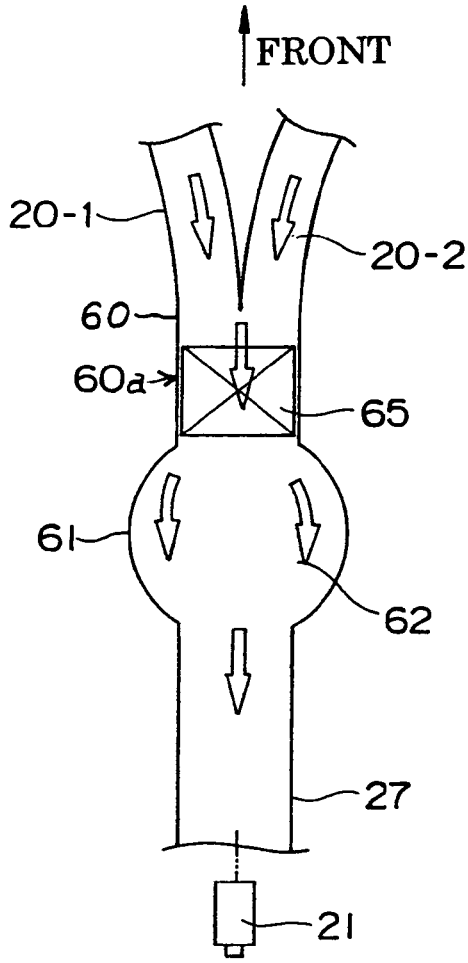
FIG. 15 is a longitudinal sectional view showing the vicinity of a collector pipe of an exhaust apparatus according to a fourth embodiment of the present invention.

FIG. 15 shows a fourth embodiment of the present invention. The fourth embodiment is an example in which the invention is applied to an exhaust apparatus including the right and left individual cylinder exhaust pipes 20-1 and 20-2, one exhaust collector pipe 60, and one exhaust muffler 21. A honeycomb type catalyst 65 is arranged in an exhaust collector portion 60*a* formed in the rear half portion of the exhaust collector pipe 60, a substantially spherical expansion pipe 61 is immediately connected to the exhaust collector portion 60*a*, and a substantially spherical expansion chamber 62 is formed in the expansion pipe 61. In the fourth embodiment, the same components as in the first embodiment are designated by the same numerals.

In the fourth embodiment, as with the first embodiment, the generation of the torque valley can be eliminated during the acceleration in a low-speed range.

Fifth Embodiment

Figure 16:
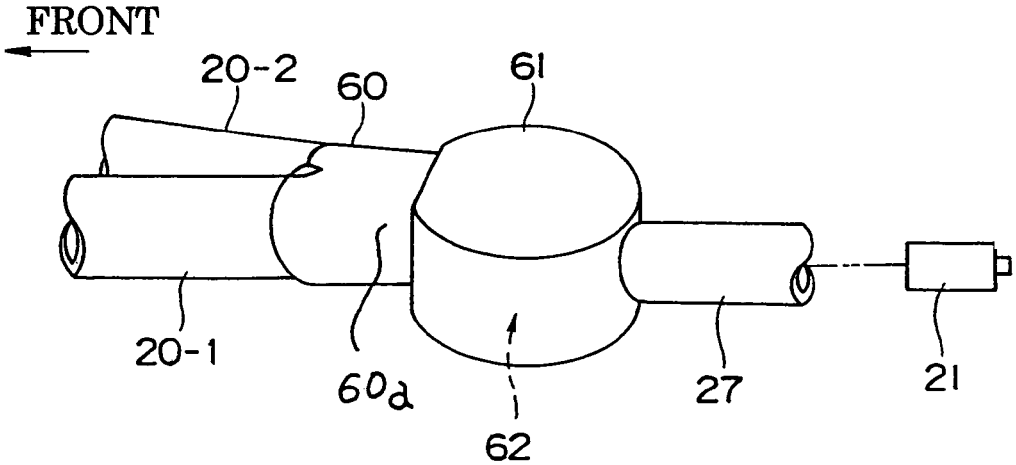
FIG. 16 is a perspective view showing the vicinity of a collector pipe of an exhaust apparatus according to a fifth embodiment of the present invention.

FIG. 16 shows a fifth embodiment of the present invention. Similarly to the fourth embodiment, the fifth embodiment is an example in which the invention is applied to the exhaust apparatus including right and left individual cylinder exhaust pipes 20-1 and 20-2, one exhaust collector pipe 60, one expansion pipe 61, one rear exhaust pipe 27, and one exhaust muffler 21. However, in the fifth embodiment, the expansion pipe 61 is formed in a cylindrical shape flattened in the vertical direction, and the expansion chamber 62 in the expansion pipe 61 is also formed in a cylindrical shape flattened in the vertical direction. That is, the expansion pipe 61 and the expansion chamber 62 are formed in the substantially circular shape when viewed from the top, and the expansion pipe 61 and the expansion chamber 62 are formed in the rectangular shape in which the height is smaller than the width in the horizontal direction when viewed from the side. In the fifth embodiment, the same components as in the first embodiment are designated by the same numerals.

In the fifth embodiment, as with the first embodiment, obviously the generation of the torque valley can be eliminated during acceleration in the low-speed range of the engine. Additionally, in the case where the expansion pipe 61 is arranged below the engine of the motorcycle shown in FIG. 1, the height from the ground surface to the expansion pipe 61 can be maintained at a high level while the compact size can be realized in the vertical direction of the expansion pipe 61, so that a banking angle can be increased for the motorcycle.

Other Embodiments (1) In the above embodiments, the sectional shape of the expansion chamber is formed so that the whole or a part of the circumference is projected outward in a substantially arc shape. However, the present invention is not limited to the arc shape. Alternatively, the sectional shape may be formed in a mountain shape such as a single mountain shape, or a mountain-range shape in which plural mountains are continued.

(2) The vehicle exhaust apparatus of the present invention can also be applied to a vehicle exhaust apparatus for a saddle type four-wheeled running vehicle, small water plane boat, and the like. Further, the invention can also be applied to a 3-cylinder engine and an engine having five cylinders or more.

The present invention is not limited to the structures of the above embodiments, but various changes and modifications can be made as long as such changes and modifications do not deviate from the scope of the invention.

What is claimed is:

1. A vehicle exhaust apparatus configured to constitute an exhaust passage to an exhaust muffler from a plurality of exhaust pipes connected to a multi-cylinder engine, the vehicle exhaust apparatus comprising:

an exhaust collector portion configured to connect to an exhaust gas downstream end of each of the plurality of exhaust pipes so that the exhaust pipes are collected at the exhaust collector portion; and an expansion chamber having an exhaust gas upstream side connected onto an exhaust gas downstream end of the exhaust collector portion, the expansion chamber being formed, at the exhaust gas upstream side of the expansion chamber, so as to expand outward from the exhaust collector portion, in a substantially arc shape when viewed in a direction substantially orthogonal to an exhaust gasflow direction of the expansion chamber, and the expansion chamber further being formed, at an exhaust gas downstream side of the expansion chamber, so as to contract inward along an arc shape of the expansion chamber when viewed in a direction substantially orthogonal to the exhaust gasflow direction of the expansion chamber;

wherein the expansion chamber is formed in a substantially spherical shape.

2. A vehicle exhaust apparatus configured to constitute an exhaust passage to an exhaust muffler from a plurality of exhaust pipes connected to a multi-cylinder engine, the vehicle exhaust apparatus comprising:

an exhaust collector portion configured to connect to an exhaust gas downstream end of each of the plurality of exhaust pipes so that the exhaust pipes are collected at the exhaust collector portion; and an expansion chamber having an exhaust gas upstream side connected onto an exhaust gas downstream end of the exhaust collector portion, the expansion chamber being formed, at an exhaust gas downstream side of the expansion chamber, so as to contract inward along an arc shape of the expansion chamber when viewed in a direction substantially orthogonal to an exhaust gasflow direction of the expansion chamber;

wherein the expansion chamber is formed in a substantially hemispherical shape.

3. A vehicle exhaust apparatus configured to constitute an exhaust passage to an exhaust muffler from a plurality of exhaust pipes connected to a multi-cylinder engine, the vehicle exhaust apparatus comprising:

an exhaust collector portion configured to connect to an exhaust gas downstream end of each of the plurality of exhaust pipes so that the exhaust pipes are collected at the exhaust collector portion; and an expansion chamber having an exhaust gas upstream side connected onto an exhaust gas downstream end of the exhaust collector portion, the expansion chamber being formed, at the exhaust gas upstream side of the expansion chamber, so as to expand outward from the exhaust collector portion in a substantially arc shape when viewed in a direction substantially orthogonal to an exhaust gasflow direction of the expansion chamber, and the expansion chamber further being formed, at an exhaust gas downstream side of the expansion chamber, so as to contract inward along an arc shape of the expansion chamber when viewed in a direction substantially orthogonal to the exhaust gasflow direction of the expansion chamber;

wherein the expansion chamber is formed in a flattened shape such that, with the vehicle exhaust apparatus oriented substantially horizontally, the vertical width of the expansion chamber is narrower than the horizontal width of the expansion chamber in a direction substantially orthogonal to the exhaust gasflow direction.

4. The vehicle exhaust apparatus according to claim 3, wherein the expansion chamber is formed in a cylindrical shape flattened in a vertical direction.

* * * * *